US011318486B2

(12) United States Patent
Wang et al.

(10) Patent No.: US 11,318,486 B2
(45) Date of Patent: May 3, 2022

(54) WATER OUTLET DEVICE WITH ADJUSTABLE WATER POWER

(71) Applicant: Xiamen Lota International Co., Ltd., Fujian (CN)

(72) Inventors: Xuedong Wang, Fujian (CN); Jiangcheng Zhang, Fujian (CN); Chuanbao Zhu, Fujian (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 98 days.

(21) Appl. No.: 16/829,050

(22) Filed: Mar. 25, 2020

(65) Prior Publication Data

US 2020/0306774 A1 Oct. 1, 2020

(30) Foreign Application Priority Data

Mar. 25, 2019 (CN) ..... 201910227929.0

(51) Int. Cl.
*B05B 1/30* (2006.01)
*B05B 1/18* (2006.01)

(52) U.S. Cl.
CPC ..... *B05B 1/3026* (2013.01); *B05B 1/185* (2013.01)

(58) Field of Classification Search
CPC ..... B05B 1/3026; B05B 1/185; B05B 1/3046; B05B 1/18; B05B 1/3033; B05B 12/087
See application file for complete search history.

(56) References Cited

U.S. PATENT DOCUMENTS 11,014,101 B2 * 5/2021 Zhuo ..... B05B 15/5225

* cited by examiner

*Primary Examiner* — Qingzhang Zhou
(74) *Attorney, Agent, or Firm* — Cooper Legal Group, LLC

(57) ABSTRACT

The present disclosure discloses a water outlet device with adjustable water power. The water outlet device comprises a fixed portion, a water outlet portion, and an adjusting member. The fixed portion comprises a water inlet passage and a first connection portion. The adjusting member is disposed in the water outlet portion and is configured to move relative to the water outlet portion. The adjusting member comprises a second connection portion and an adjusting portion, the adjusting portion corresponds to the water outlet hole. The first connection portion and the second connection portion cooperate to drive the adjusting member to move close to or away from the water outlet portion so as to adjust a power of water flowing out from the water outlet hole.

12 Claims, 10 Drawing Sheets

WATER OUTLET DEVICE WITH ADJUSTABLE WATER POWER

RELATED APPLICATIONS

This application claims priority to Chinese Patent Application 201910227929.0, filed on Mar. 25, 2019. Chinese Patent Application 201910227929.0 is incorporated herein by reference.

FIELD OF THE DISCLOSURE

The present disclosure relates to a water outlet device with adjustable water power, and in particular relates to an adjustable shower and a pull-out kitchen faucet.

BACKGROUND OF THE DISCLOSURE

Existing water outlet devices, such as showers or faucets, generally have conventional water passages and adjusting water passages. The water passages are switched by a switch valve so as to achieve an adjustment. Due to the presence of multiple water passages, the showers or the faucets are large in size and comprise complicated structures. It is necessary to improve existing water outlet devices with adjustable water power.

BRIEF SUMMARY OF THE DISCLOSURE

The present disclosure provides a water outlet device with adjustable water power to solve deficiencies of the existing techniques.

In order to solve the aforementioned technical problems, a technical solution of the present disclosure is as follows.

A water outlet device with adjustable water power comprises a fixed portion, a water outlet portion disposed on the fixed portion, and an adjusting member. The fixed portion comprises a water inlet passage and a first connection portion. The water outlet portion comprises a water outlet hole connected with the water inlet passage. The adjusting member is disposed in the water outlet portion and is configured to move relative to the water outlet portion. The adjusting member comprises a second connection portion and an adjusting portion, the adjusting portion corresponds to the water outlet hole. The first connection portion and the second connection portion cooperate to drive the adjusting member to move close to or away from the water outlet portion to enable the adjusting portion to move between a first position relative to the water outlet hole and a second position relative to the water outlet hole so as to adjust a power of water flowing out from the water outlet hole.

In another preferred embodiment, the adjusting portion comprises an adjusting column. At least one step surface is disposed on an outer periphery of the adjusting column, and the at least one step surface divides the adjusting column into at least two step columns.

In another preferred embodiment, a wall of the water outlet hole comprises a step surface, and the step surface divides the water outlet hole into an inlet end and an outlet end. The adjusting portion corresponds to the inlet end of the water outlet hole or the outlet end of the water outlet hole In another preferred embodiment, when the adjusting portion corresponds to the inlet end of the water outlet hole, a maximum diameter of the adjusting portion is smaller than a diameter of the inlet end of the water outlet hole. When the adjusting portion corresponds to the outlet end of the water outlet hole, the maximum diameter of the adjusting portion is smaller than a diameter of the outlet end of the water outlet hole.

In another preferred embodiment, the water outlet portion is fixedly disposed on the fixed portion or is movably disposed on the fixed portion.

In another preferred embodiment, the water outlet portion is rotatably disposed on the fixed portion. The first connection portion comprises a sheet body, the sheet body comprises a plurality of connection surfaces each having a sequentially reduced height. The second connection portion comprises a connection column, and the water outlet portion rotates to drive the adjusting member to rotate synchronously so that the connection column sequentially abuts the plurality of connection surfaces to drive the adjusting member to move close to or away from the water outlet portion.

In another preferred embodiment, the water outlet device with adjustable water power further comprises a resetting elastic member, and the resetting elastic member surrounds an outer side of the adjusting column and is disposed between the adjusting member and the water outlet portion.

In another preferred embodiment, a top surface of the water outlet portion is disposed with a first positioning portion and a second positioning portion, and opposite sides of the first connection portion are respectively cooperate with the first positioning portion and the second positioning portion to limit movement of the water outlet portion in a circumferential direction.

In another preferred embodiment, the fixed portion comprises a gear pin, a top surface of the water outlet portion comprises a plurality of gear position holes disposed in a circumferential direction at intervals, and the gear pin corresponds to the plurality of gear position holes.

In another preferred embodiment, the fixed portion comprises a water outlet body and a fixed plate disposed on the water outlet body. The water inlet passage is disposed in the water outlet body. The fixed plate is disposed with a first water passing hole connected to the water inlet passage. The first connection portion is fixedly connected to an outer periphery of the fixed plate.

In another preferred embodiment, the water outlet portion comprises a water passing plate and a water outlet assembly fixedly connected to the water passing plate. The water outlet assembly comprises the water outlet hole. The water passing plate is disposed between the water outlet assembly and the fixed plate and is connected to the fixed plate. The water passing plate comprises a second water passing hole configured to be connected to the first water passing hole.

In another preferred embodiment, the second connection portion and the adjusting portion are respectively fixedly connected to a top surface and a bottom surface of the adjusting member. The adjusting member is disposed between the water passing plate and the water outlet assembly. The water passing plate comprises a hole, and the second connection portion passes through the hole and cooperates with the first connection portion. The adjusting member comprises a third water passing hole configured to be connected to the second water passing hole and the water outlet hole.

In another preferred embodiment, the water outlet device with adjustable water power further comprises a resetting elastic member, and the resetting elastic member is disposed between the adjusting member and the water outlet portion.

Compared with existing techniques, the technical solution provided by the present disclosure has the following advantages.

1. As the adjusting member can move close to or away from the water outlet portion, the first connection portion cooperates with the second connection portion to drive the adjusting member to move close to or away from the water outlet portion to enable the adjusting portion to move between a first position relative to the water outlet hole and a second position relative to the water outlet hole so as to adjust a power of water flowing out from the water outlet hole. For example, when the adjusting portion is disposed in the water outlet hole, a water outlet area of the water outlet hole decreases, when an inflow water has a certain water pressure, a flow velocity of an outflow water will increase, a power of the outflow water will increase, and the outflow water will impact the user harder. When the adjusting portion is spaced apart from the water outlet hole, the water outlet area of the water outlet hole increases, when the inflow water has the certain water pressure, the flow velocity will decrease, the power of the outflow water will decrease, and the outflow water will impact the user less, resulting in a softer feel. This kind of water outlet device can achieve an adjustment of different water powers without adding water passages, and a volume of the water outlet device can be more compact.

2. The outer periphery of the adjusting column comprises at least one step surface. The at least one step surface enables the adjusting column to be divided into at least two step columns, and the water outlet area of the water outlet hole can be adjusted in different gear positions to meet needs of different users.

3. The adjusting portion corresponds to the inlet end of the water outlet hole or the outlet end of the water outlet hole, and a cooperation structure of the adjusting portion and the water outlet hole is more flexible.

4. When the adjusting portion corresponds to the inlet end of the water outlet, the maximum diameter of the adjusting portion is smaller than the diameter of the inlet end of the water outlet hole. When the adjusting portion corresponds to the outlet end of the water outlet, the maximum diameter of the adjusting portion is smaller than the diameter of the outlet end of the water outlet hole. No matter how the adjusting portion cooperates with the water outlet hole, the water outlet hole is always connected with the water inlet passage, and the water outlet hole is always in a state ready to discharge water.

5. Because the connection column sequentially abuts the plurality of connection surfaces to drive the adjusting member to move close to or away from the water outlet portion, an effect of the connection is more stable and reliable.

6. The resetting elastic member surrounds the outer side of the adjusting column and is disposed between the adjusting member and the water outlet portion. When the connection column is switched so as to contact a higher connection surface instead of a lower connection surface, the resetting elastic member can drive the adjusting member to a corresponding height synchronously.

7. The gear pin corresponds to the plurality of gear position holes to improve a gear position feel when being switched.

BRIEF DESCRIPTION OF THE DRAWING

The present disclosure will be further described below with the combination of the accompanying drawings and the embodiments.

DETAILED DESCRIPTION OF THE EMBODIMENTS

Embodiment 1

Figure 1:
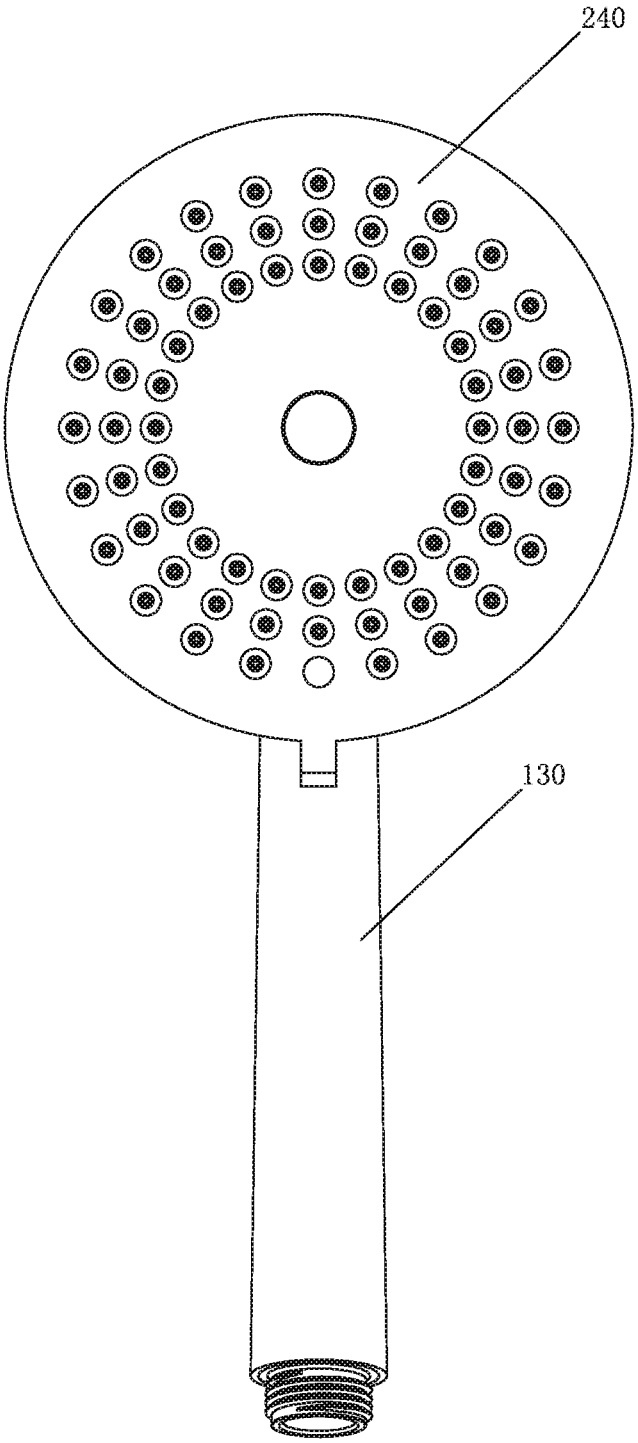
FIG. 1 illustrates a front schematic view of a water outlet device of Embodiment 1 of the present disclosure.

Referring to FIGS. 1-9, a water outlet device with adjustable water power of Embodiment 1 comprises a shower structure. The shower structure comprises a fixed portion 100, a water outlet portion 200, and an adjusting member 300.

The fixed portion 100 comprises a water inlet passage 110 and at least one first connection portion 120.

In this embodiment, the fixed portion 100 comprises a water outlet body 130 and a fixed plate 140 fixedly disposed on the water outlet body 130. The water inlet passage 110 is disposed in the water outlet body 130. The fixed plate 140 comprises at least one first water passing hole 141 connected to the water inlet passage 110, and the at least one first connection portion 120 is fixedly disposed on an outer periphery of the fixed plate 140. The water outlet body 130 can be fixedly connected to the fixed plate 140 by welding or integrally molding, however, a specific connection method is not limited thereto.

In this embodiment, the at least one first connection portion 120 comprises two first connection portions 120, and the two first connection portions 120 are axially symmetrically disposed on the fixed plate 140. The at least one first water passing hole 141 is disposed between the two first connection portions 120. A rotating shaft 142 is further disposed at a center of a bottom surface of the fixed plate 140.

Figure 2:
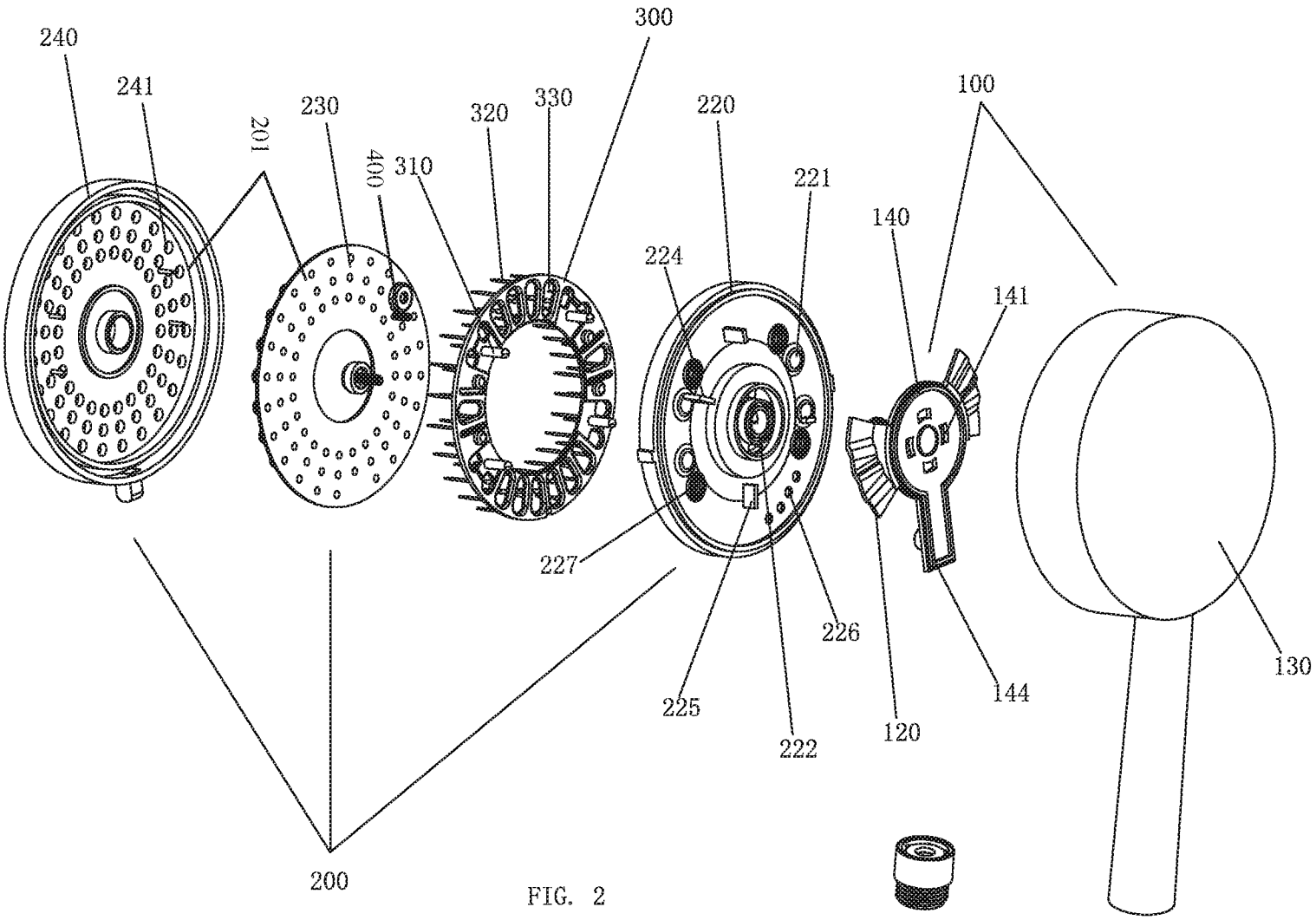
FIG. 2 illustrates a first exploded perspective view of the water outlet device of Embodiment 1 of the present disclosure.
Figure 3:
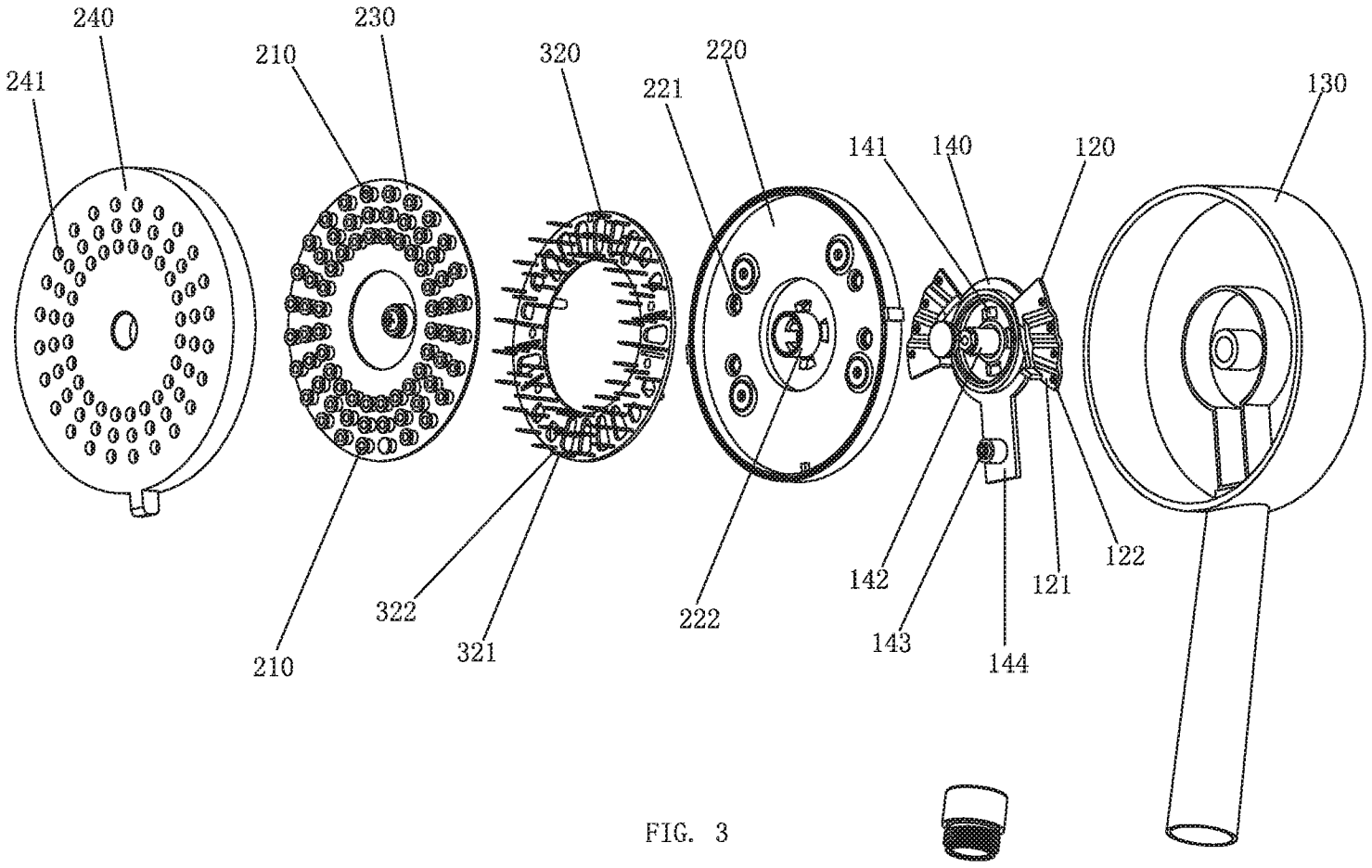
FIG. 3 illustrates a second exploded perspective view of the water outlet device of Embodiment 1 of the present disclosure.

In this embodiment, the at least one first connection portion 120 comprises a sheet body, and the sheet body comprises a plurality of connection surfaces 121 each having a sequentially reduced height. As shown in FIG. 2 and FIG. 3, the plurality of connection surfaces 121 comprise four connection surfaces 121, and each of the four connection surfaces 121 comprises a positioning groove 122. The fixed plate 140 further comprises a gear pin 143 facing the water outlet portion 200.

In this embodiment, a circumference of the fixed plate 140 comprises an extension arm 144 extending outward, and the gear pin 143 is disposed an outer end of the extension arm 144.

The water outlet portion 200 is disposed on the fixed portion 100 and is disposed with at least one water outlet hole 210 configured to be connected to the water inlet passage 110.

The water outlet portion 200 is fixedly disposed on the fixed portion 100 or is movably disposed on the fixed portion 100. In this embodiment, the water outlet portion 200 is rotatably disposed on the fixed portion 100. In some embodiments, the water outlet portion 200 can also be disposed on the fixed portion 100 and be configured to move in an axial direction. A connection relationship between the water outlet portion 200 and the fixed portion 100 is not limited to the aforementioned connection relationships so long as a position of the adjusting member 300 is adjustable.

In this embodiment, the water outlet portion 200 comprises a water passing plate 220 and a water outlet assembly 201 fixedly connected to the water passing plate 220. The at least one water outlet hole 210 is disposed in the water outlet assembly 201. The fixed plate 140 is disposed between the water outlet assembly 201 and the fixed plate 140 and is rotatably connected to the fixed plate 140, and the water passing plate 220 is disposed with at least one second water passing hole 221 configured to be connected to the at least one first water passing hole 141. The water passing plate 220 can be fixedly connected to the water outlet assembly 201 by welding or clamping but is not limited thereto.

In this embodiment, as shown in FIG. 2 and FIG. 3, a shaft sleeve 222 is disposed on a center of the water passing plate 220. The rotating shaft 142 extends into the shaft sleeve 222, and the water passing plate 220 is rotatably connected to the fixed plate 140 when the rotating shaft 142 is locked with a screw 223.

Figure 5:
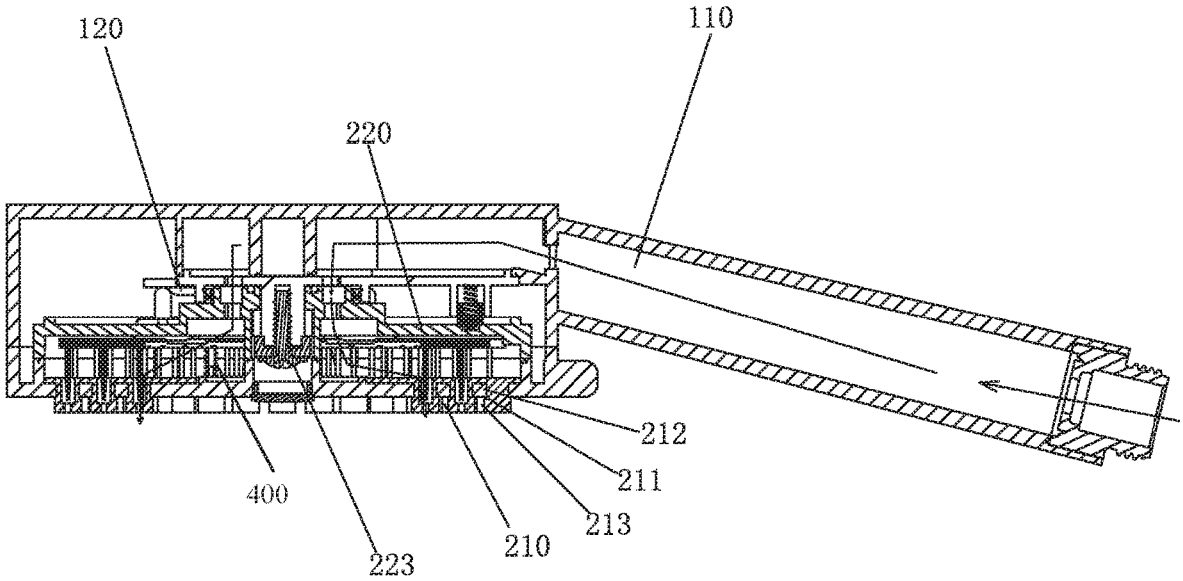
FIG. 5 illustrates a schematic view of a water flow passage of the water outlet device of Embodiment 1 of the present disclosure.

In this embodiment, the water outlet assembly 201 comprises a water outlet plate 230 and a cover 240 fixedly connected to the water outlet plate 230. The water outlet plate 230 comprises the at least one water outlet hole 210, and the cover 240 comprises at least one opening 241 corresponding to the at least one water outlet hole 210 in a one to one connection. The number of openings 241 is the same as the number of water outlet holes 210, and a periphery of the cover 240 is disposed with a toggle block 242. A wall of each of the at least one water outlet hole 210 comprises a step surface 211 to enable each of the at least one water outlet hole 210 to be divided into an inlet end 212 and an outlet end 213. As shown in FIG. 5, a diameter of the inlet end 212 is larger than a diameter of the outlet end 213.

Figure 4:
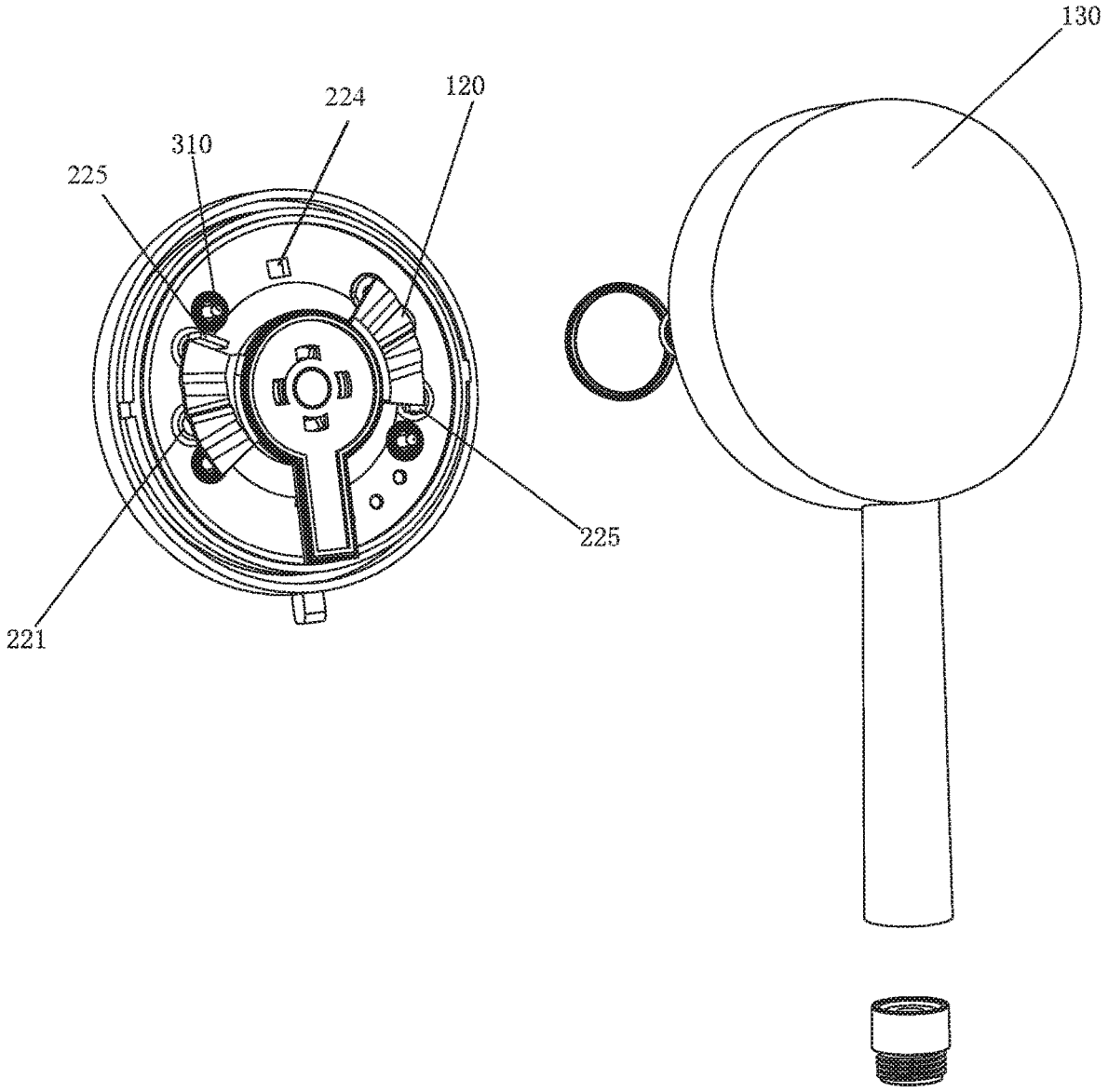
FIG. 4 illustrates a third exploded perspective view of the water outlet device of Embodiment 1 of the present disclosure.

In this embodiment, at least one first positioning portion 224 and at least one second positioning portion 225 are disposed on a circumference of a top surface of the water passing plate 220 at intervals, and opposite sides of each of the at least one first connection portion 120 respectively cooperate with a corresponding one of the at least one first positioning portion 224 and a corresponding one of the at least one second positioning portion 225 to limit movement of the water outlet portion 200 in a circumferential direction. As shown in FIG. 4, the at least one first positioning portion 224 comprises two first positioning portions 224, the at least one second positioning portion 225 comprises two second positioning portions 225. Each of the two first positioning portions 224 and a corresponding one of the two second positioning portions 225 corresponds to a corresponding one of the at least one first connection portion 120. The at least one second water passing hole 221 is disposed between the two first positioning portions 224 and the two second positioning portions 225.

In this embodiment, the top surface of the water passing plate 220 comprises a plurality of gear position holes 226 disposed in a circumferential direction at intervals, and the gear pin 143 corresponds the plurality of gear position holes 226. As shown in FIG. 2, the plurality of gear position holes 226 comprises four gear position holes.

In this embodiment, the water passing plate 220 is further disposed with at least one hole 227 passing through the water passing plate 220.

The adjusting member 300 is disposed in the water outlet portion 200 and is configured to move relative to the water outlet portion 200. The adjusting member 300 comprises at least one second connection portion 310 and at least one adjusting portion 320. The at least one adjusting portion 320 corresponds to the at least one water outlet hole 210, and a connection of the at least one first connection portion 120 and the at least one second connection portion 310 drives the adjusting member 300 to move close to or away from the water outlet portion 200 to enable the at least one adjusting portion 320 to move between a first position relative to the water outlet hole 210 and a second position relative to the water outlet hole 210 so as to adjust a power of water flowing out from the at least one water outlet hole 210.

In this embodiment, the at least one second connection portion 310 and the at least one adjusting portion 320 are respectively fixedly disposed on a top surface and a bottom surface of the adjusting member 300, and the adjusting member 300 is disposed between the water passing plate 220 and the water outlet plate 230. The at least one second connection portion 310 passes through the at least one hole 227 and then cooperates with the at least one first connection portion 120. The adjusting member 300 comprises at least one third water passing hole 330 configured to be connected to the at least one second water passing hole 221 and the at least one water outlet hole 210.

In this embodiment, each of the at least one adjusting portion 320 is an adjusting column, and an outer side of the adjusting column comprises at least one step surface 321. The at least one step surface 321 enables the adjusting column to be divided into at least two step columns 322. As shown in FIG. 3, the at least one step surface 321 comprises two step surfaces 321. The two step surfaces 321 enable the adjusting column to be divided into three step columns 322, and a diameter of each of the three step columns 322 becomes smaller in a downward direction.

In this embodiment, as shown in FIGS. 6-9, each of the at least one adjusting portion 320 corresponds to an outlet end 213 of a corresponding one of the at least one water outlet hole 210. A maximum diameter of each of the at least one adjusting portion 320 is smaller than a diameter of the outlet end 213 of the corresponding one of the at least one water outlet hole 210.

In this embodiment, each of the at least one second connection portion 310 is a connecting column, and the water outlet portion 200 rotates to drive the adjusting member 300 to rotate synchronously so that the connecting column sequentially abuts a corresponding one of the plurality of connection surfaces 121 to move the adjusting member 300 close to or away from the water outlet portion.

In this embodiment, the number of connection surfaces 121 is one more than the number of the step columns 322.

In this embodiment, the water outlet device further comprises a resetting elastic member 400. The resetting elastic member 400 is a spring. The resetting elastic member 400 surrounds an outer side of one or more of the adjusting columns and is disposed between the adjusting member 300 and the water outlet plate 230.

Figure 6:
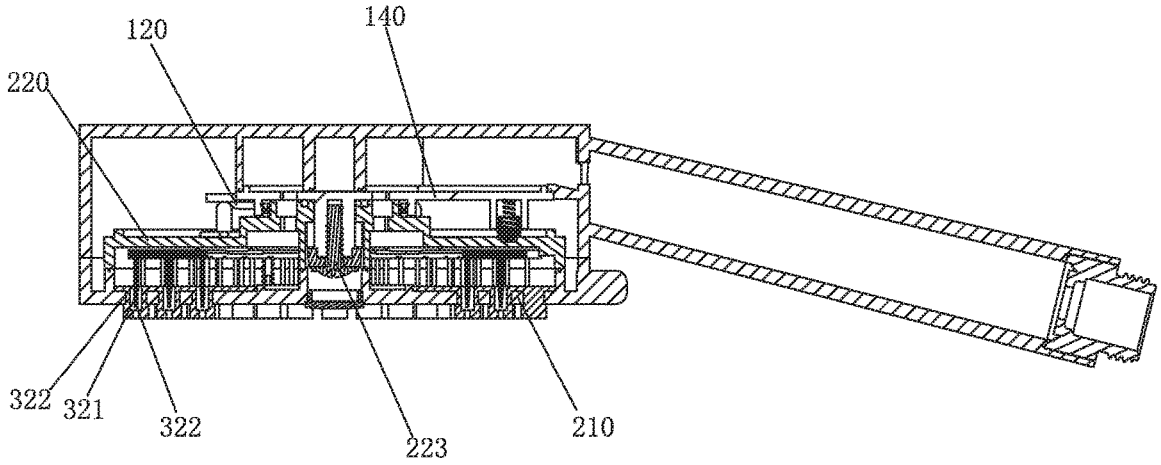
FIG. 6 illustrates a cross-sectional view of the water outlet device of Embodiment 1 when an adjusting portion is at an initial position.

As shown in FIG. 6, at this time, the adjusting column is separated from the outlet end 213 of the at least one water outlet hole 210. That is, each of the at least one adjusting portion 320 is disposed above the outlet end 213 of the corresponding one of the at least one water outlet hole 210. As a diameter of each of the at least one adjusting portion 320 is small and a length of each of the at least one adjusting portion 320 is long, a water outlet area of the inlet end 212 of a corresponding one of the at least one water outlet hole 210 will not be significantly influenced and can be ignored. At this time, the connecting column abuts a highest positioning groove 122 of the at least one positioning groove 122 disposed on a corresponding one of the plurality of connection surfaces 121. In this state, a water outlet area of the at least one water outlet hole 210 is the largest. When an incoming water pressure has a first value, the water power is the smallest and the water has the softest feel.

Figure 7:
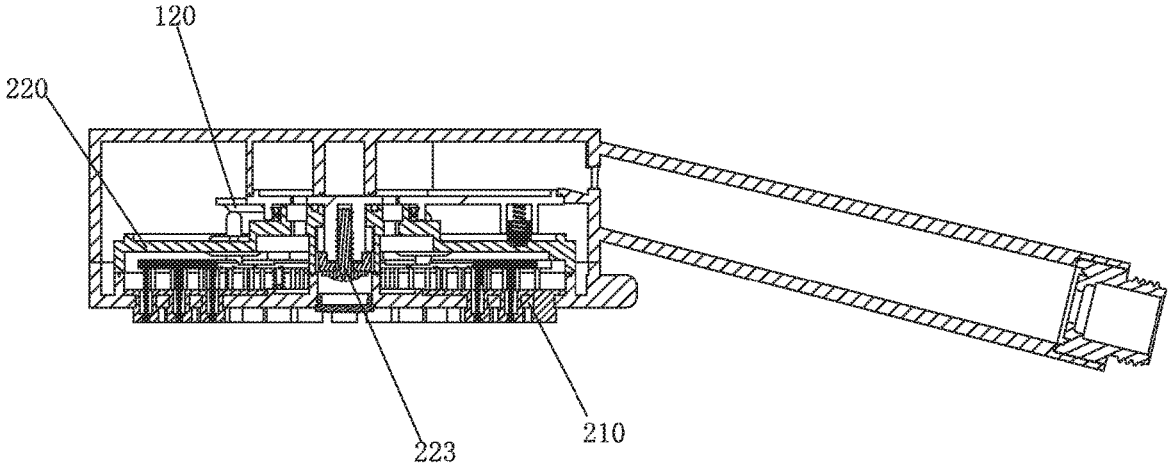
FIG. 7 illustrates a cross-sectional view of the water outlet device of Embodiment 1 when the adjusting portion is at a first adjusting position.

As shown in FIG. 7, a bottommost step column 322 of the adjusting column is inserted into the outlet end 213 of the corresponding one of the at least one water outlet hole 210. At this time, the connection column abuts a second-highest positioning groove 122 of the at least one positioning groove 122 disposed on the corresponding one of the plurality of connection surfaces 121. The water outlet area of the at least one water outlet hole 210 is smaller than the water outlet area illustrated in FIG. 6. When the incoming water pressure has the first value, the water power is greater than that of FIG. 6 and a water spray is more powerful.

Figure 8:
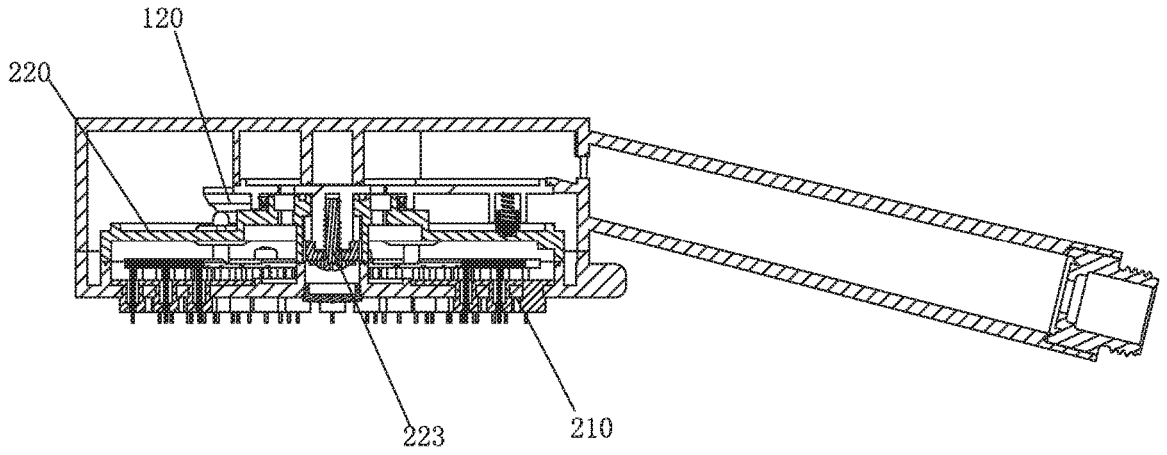
FIG. 8 illustrates a cross-sectional view of the water outlet device of Embodiment 1 when the adjusting portion is at a second adjusting position.

As shown in FIG. 8, a second step column 322 of the adjusting column is inserted into the outlet end 213 of the corresponding one of the at least one water outlet hole 210, and the bottommost step column 322 extends out of the corresponding one of the at least one water outlet hole 210. At this time, the connecting column abuts a third-highest positioning groove 122 of the at least one positioning groove 122 disposed on a corresponding one of the plurality of connection surfaces 121. At this time, the water outlet area of the at least one water outlet hole 210 is smaller than the water outlet area illustrated in FIG. 7. When the incoming water pressure has the first value, the water power is greater than that of FIG. 7 and the water spray is even more powerful.

Figure 9:
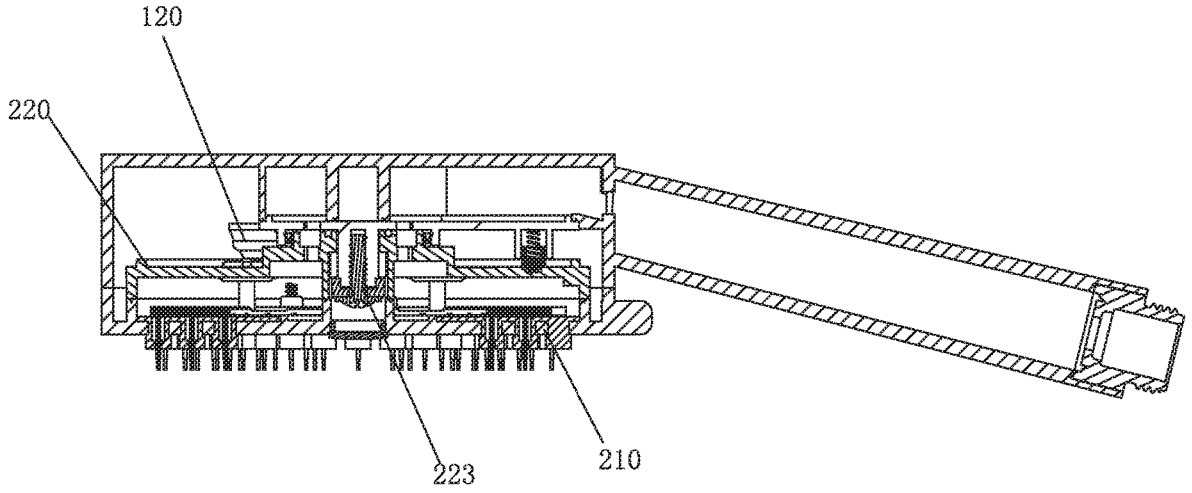
FIG. 9 illustrates a cross-sectional view of the water outlet device of Embodiment 1 when the adjusting portion is at a third adjusting position.

As shown in FIG. 9, a topmost step column 322 of the adjusting column is inserted into the outlet end 213 of the corresponding one of the at least one water outlet hole 210, and two lower step columns 322 of the adjusting column extend out of the corresponding one of the at least one water outlet hole 210. At this time, the connecting column abuts a lowest positioning groove 122 of the at least one positioning groove 122 disposed on a corresponding one of the plurality of connection surfaces 121. At this time, the water outlet area of the at least one water outlet hole 210 is the smallest. When the incoming water pressure has the first value, the water power is the largest and the water spray is the most powerful.

Embodiment 2

As shown in FIGS. 10-13, the water outlet device with adjustable water power of Embodiment 2 differs from Embodiment 1 as follows.

In this embodiment, each of the at least one adjusting portion 320 corresponds to the inlet end 212 of the corresponding one of the at least one water outlet hole 210, and a maximum diameter of each of the at least one adjusting portion 320 is smaller than a diameter of the inlet end 212 of the corresponding one of the at least one water outlet hole 210.

Figure 10:
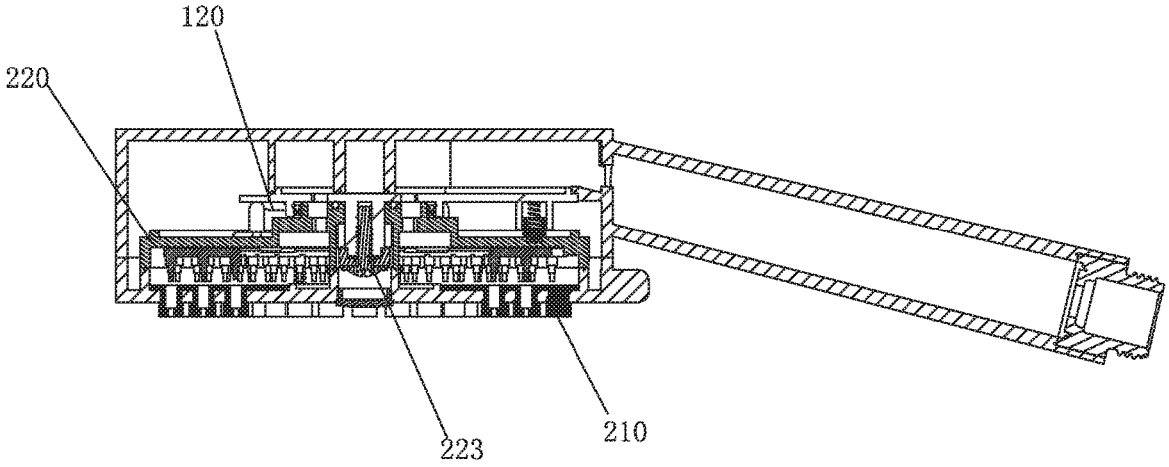
FIG. 10 illustrates a cross-sectional view of a water outlet device of Embodiment 2 when the adjusting portion is at an initial position.

As shown in FIG. 10, at this time, the adjusting column is separated from the inlet end 212 of the at least one water outlet hole 210. That is, each of the at least one adjusting portion 320 is disposed above the inlet end 212 of the corresponding one of the at least one water outlet hole 210. A diameter of each of the at least one adjusting portion 320 is larger than that of Embodiment 1. At this time, the connecting column abuts a highest positioning groove 122 of the at least one positioning groove 122 of a corresponding one of the plurality of connection surfaces 121. In this state, a water outlet area of the at least one water outlet hole 210 is the largest. When an incoming water pressure has the first value, the water power is the smallest and the water has the softest feel.

Figure 11:
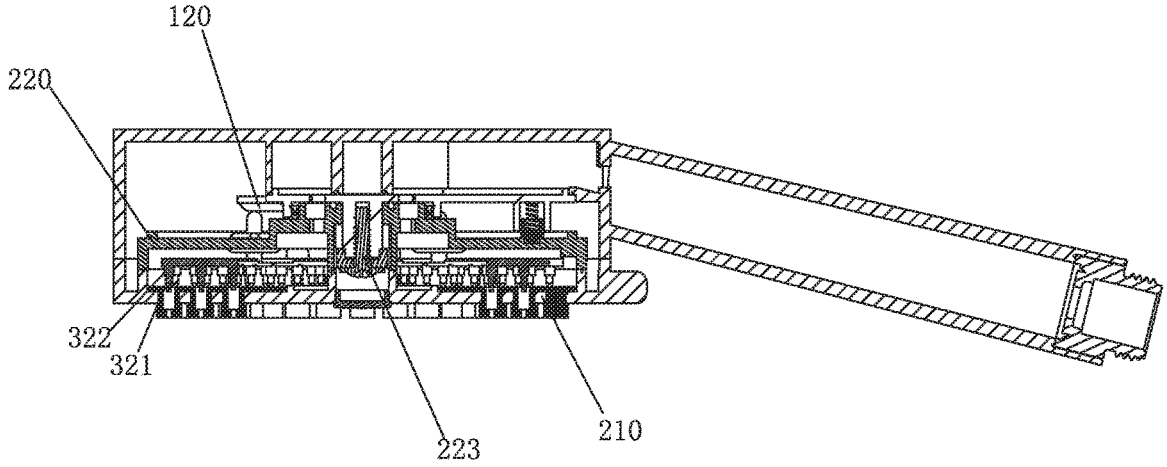
FIG. 11 illustrates a cross-sectional view of the water outlet device of Embodiment 2 when the adjusting portion is at a first adjusting position.

As shown in FIG. 11, a bottommost step column 322 of the adjusting column is inserted into the inlet end 212 of the corresponding one of the at least one water outlet hole 210. At this time, the connection column abuts a second-highest positioning groove 122 of the at least one positioning groove 122 disposed on the corresponding one of the plurality of connection surfaces 121. The water outlet area of the at least one water outlet hole 210 is smaller than the water outlet area illustrated in FIG. 10. When the incoming water pressure has the first value, the water power is greater than that of FIG. 10 and a water spray is more powerful.

Figure 12:
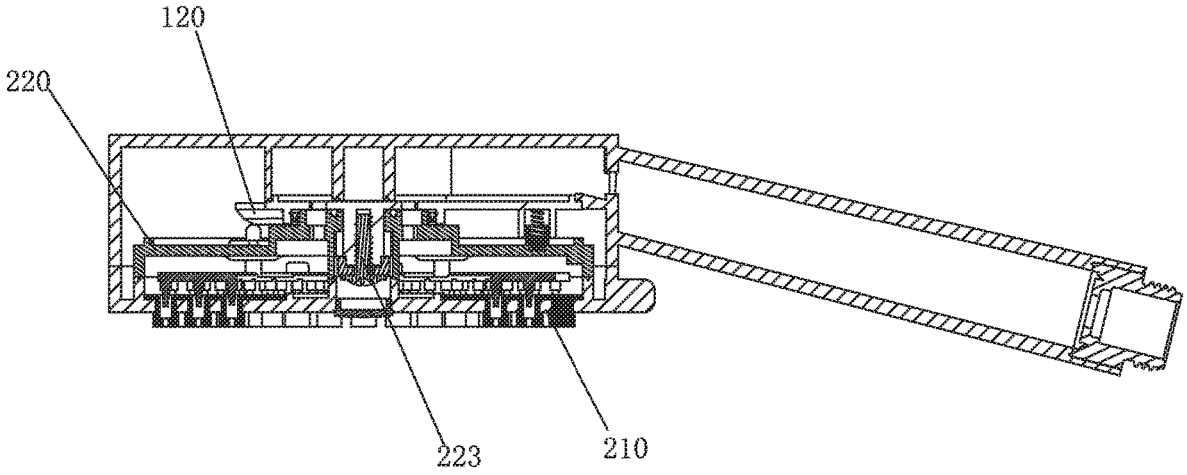
FIG. 12 illustrates a cross-sectional view of the water outlet device of Embodiment 2 when the adjusting portion is at a second adjusting position.

As shown in FIG. 12, a second step column 322 of the adjusting column is inserted into the inlet end 212 of the corresponding one of the at least one water outlet hole 210, and the bottommost step column 322 is also inserted into the corresponding one of the at least one water outlet hole 210. At this time, the connecting column abuts a third-highest positioning groove 122 of the at least one positioning groove 122 disposed on a corresponding one of the plurality of connection surfaces 121. At this time, the water outlet area of the at least one water outlet hole 210 is smaller than the water outlet area illustrated in FIG. 11. When the incoming water pressure has the first value, the water power is greater than that of FIG. 11 and the water spray is even more powerful.

Figure 13:
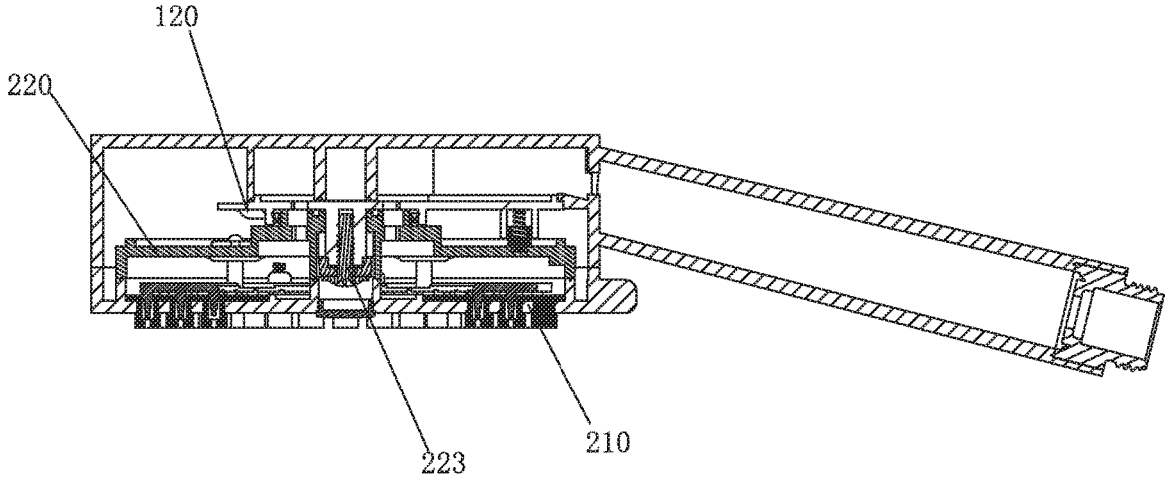
FIG. 13 illustrates a cross-sectional view of the water outlet device of Embodiment 2 when the adjusting portion is at a third adjusting position.
Figure 14:
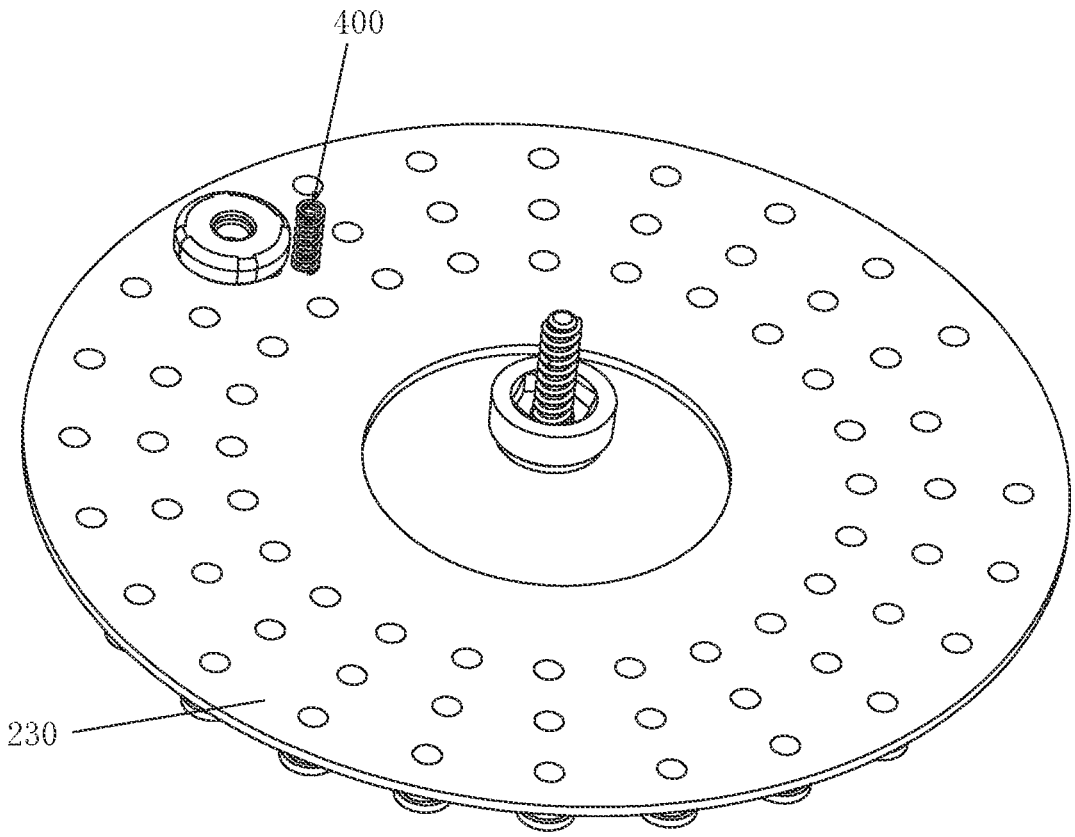
FIG. 14 illustrates an enlarged view of a water outlet plate of Embodiment 1 of the present disclosure.

As shown in FIG. 13, a topmost step column 322 of the adjusting column is inserted into the inlet end 212 of the corresponding one of the at least one water outlet hole 210, and two lower step columns 322 of the adjusting column is also inserted into the corresponding one of the at least one water outlet hole 210. At this time, the connecting column abuts a lowest positioning groove 122 of the at least one positioning groove 122 disposed on a corresponding one of the plurality of connection surfaces 121. At this time, the water outlet area of the at least one water outlet hole 210 is smallest. When the incoming water pressure has the first value, the water power is the largest and the water spray is the most powerful.

The water outlet device with adjustable water power can also be a pull-out kitchen shower or can be a faucet structure. However, the water outlet device with adjustable water power is not limited thereto.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A water outlet device with adjustable water power, comprising:

a fixed portion, a water outlet portion disposed on the fixed portion, and an adjusting member, wherein:

the fixed portion comprises a water inlet passage and a first connection portion, the water outlet portion comprises a water outlet hole connected with the water inlet passage, the adjusting member is disposed in the water outlet portion and is configured to move relative to the water outlet portion, the adjusting member comprises a second connection portion and an adjusting portion, the adjusting portion corresponds to the water outlet hole, the first connection portion and the second connection portion cooperate to drive the adjusting member to move close to or away from the water outlet portion to enable the adjusting portion to move between a first position relative to the water outlet hole and a second position relative to the water outlet hole so as to adjust a power of water flowing out from the water outlet hole, the adjusting portion comprises an adjusting column, at least one step surface is disposed on an outer periphery of the adjusting column, the at least one step surface divides the adjusting column into at least two step columns, the water outlet portion is rotatably disposed on the fixed portion, the first connection portion comprises a sheet body, the sheet body comprises a plurality of connection surfaces each having a sequentially reduced height, the second connection portion comprises a connection column, and the water outlet portion rotates to drive the adjusting member to rotate synchronously so that the connection column sequentially abuts the plurality of connection surfaces to drive the adjusting member to move close to or away from the water outlet portion.

2. The water outlet device with adjustable water power according to claim 1, wherein:

a wall of the water outlet hole comprises a step surface, the step surface divides the water outlet hole into an inlet end and an outlet end, and the adjusting portion corresponds to the inlet end of the water outlet hole or the outlet end of the water outlet hole.

3. The water outlet device with adjustable water power according to claim 2, wherein:

when the adjusting portion corresponds to the inlet end of the water outlet hole, a maximum diameter of the adjusting portion is smaller than a diameter of the inlet end of the water outlet hole, and when the adjusting portion corresponds to the outlet end of the water outlet hole, the maximum diameter of the adjusting portion is smaller than a diameter of the outlet end of the water outlet hole.

4. The water outlet device with adjustable water power according to claim 1, further comprising:

a resetting elastic member, wherein:

the resetting elastic member is a spring, and the resetting elastic member surrounds an outer side of the adjusting column and is disposed between the adjusting member and the water outlet portion.

5. The water outlet device with adjustable water power according to claim 1, wherein:

a top surface of the water outlet portion is disposed with a first positioning portion and a second positioning portion, and opposite sides of the first connection portion respectively cooperate with the first positioning portion and the second positioning portion to limit movement of the water outlet portion in a circumferential direction.

6. The water outlet device with adjustable water power according to claim 1, wherein:

the fixed portion comprises a gear pin, a top surface of the water outlet portion comprises a plurality of gear position holes disposed in a circumferential direction at intervals, and the gear pin corresponds to the plurality of gear position holes.

7. The water outlet device with adjustable water power according to claim 1, wherein:

the fixed portion comprises a water outlet body and a fixed plate disposed on the water outlet body, the water inlet passage is disposed in the water outlet body, the fixed plate is disposed with a first water passing hole connected to the water inlet passage, and the first connection portion is fixedly connected to an outer periphery of the fixed plate.

8. The water outlet device with adjustable water power according to claim 7, wherein:

the water outlet portion comprises a water passing plate and a water outlet assembly fixedly connected to the water passing plate, the water outlet assembly comprises the water outlet hole, the water passing plate is disposed between the water outlet assembly and the fixed plate and is connected to the fixed plate, and the water passing plate comprises a second water passing hole configured to be connected to the first water passing hole.

9. The water outlet device with adjustable water power according to claim 8, wherein:

the second connection portion and the adjusting portion are respectively fixedly connected to a top surface and a bottom surface of the adjusting member, the adjusting member is disposed between the water passing plate and the water outlet assembly, the water passing plate comprises a hole, the second connection portion passes through the hole and cooperates with the first connection portion, and the adjusting member comprises a third water passing hole configured to be connected to the second water passing hole and the water outlet hole.

10. The water outlet device with adjustable water power according to claim 4, wherein:

a top surface of the water outlet portion is disposed with a first positioning portion and a second positioning portion, and opposite sides of the first connection portion respectively cooperate with the first positioning portion and the second positioning portion to limit movement of the water outlet portion in a circumferential direction.

11. The water outlet device with adjustable water power according to claim 4, wherein:

the fixed portion comprises a gear pin, a top surface of the water outlet portion comprises a plurality of gear position holes disposed in a circumferential direction at intervals, and the gear pin corresponds to the plurality of gear position holes.

12. The water outlet device with adjustable water power according to claim 1, further comprising:

a resetting elastic member, wherein:

the resetting elastic member is a spring, and the resetting elastic member is disposed between the adjusting member and the water outlet portion.

* * * * *